US006170604B1

(12) United States Patent
Menzel et al.

(10) Patent No.: US 6,170,604 B1
(45) Date of Patent: Jan. 9, 2001

(54) EXHAUST GAS MUFFLER

(75) Inventors: Johannes Menzel; Bernhard Dürr, both of Stuttgart (DE)

(73) Assignee: Firma Andreas Stihl AG & Co. (DE)

( * ) Notice: Under 35 U.S.C. 154(b), the term of this patent shall be extended for 0 days.

(21) Appl. No.: 09/427,668

(22) Filed: Oct. 25, 1999

(30) Foreign Application Priority Data

Oct. 24, 1998 (DE) ..... 198 49 118

(51) Int. Cl.[7] ..... F01N 3/02
(52) U.S. Cl. ..... 181/230; 181/231
(58) Field of Search ..... 181/230, 231, 181/258, 255, 269, 272, 240, 282; 29/890.08

(56) References Cited

U.S. PATENT DOCUMENTS 5,883,342 * 3/1999 Wolpert ..... 181/230
5,959,262 * 9/1999 Menzel ..... 181/231
6,044,926 * 4/2000 Yamane et al. ..... 181/230

FOREIGN PATENT DOCUMENTS 29 29 965 2/1980 (DE) .

* cited by examiner

*Primary Examiner*—Khanh Dang
(74) *Attorney, Agent, or Firm*—Robert W. Becker & Associates

(57) ABSTRACT

An exhaust gas muffler for an internal combustion engine has a housing having an inlet and an outlet for engine exhaust gas. The housing has walls defining the interior of the housing. The housing has a first housing shell having a first connecting flange and a second housing shell having a second connecting flange, wherein the first and second connecting flanges are fastened to one another in a common flange plane. Each housing shell has a bottom. A partition is mounted in the housing and divides the interior of the housing into two compartments. The two compartments are connected by flow connections allowing passage of the engine exhaust gas between the two compartments. The partition has opposed ends supported respectively on the bottoms of the housing shells. The partition has two wall portions curved outwardly in opposite directions relative to a plane of the partition and has multiple openings. The wall portions define a damping element positioned in a flow path of the engine exhaust gas from the inlet to the outlet. Multiple openings allow passage of the engine exhaust gas therethrough. The wall portions have edges that are connected to the inlet and delimit a flow cross-section of the inlet.

18 Claims, 4 Drawing Sheets

EXHAUST GAS MUFFLER

BACKGROUND OF THE INVENTION

The present invention relates to an exhaust gas muffler for an internal combustion engine, especially for a hand-held work tool such as a motor chain saw, especially comprising a muffler housing which has an inlet and an outlet for the exhaust gas. A partition within the housing comprises a damping element having multiple openings and being positioned in the flow path of the exhaust gas.

Exhaust gas mufflers are arranged in the exhaust gas flow of internal combustion engines and are supposed to smooth the exhaust gas pulsation so that the noise level is substantially reduced.

A German patent document 29 29 965 A1 shows an exhaust gas muffler which is arranged in the exhaust gas manifold of an internal combustion engine that drives a chain saw and whose exhaust gas muffler housing has an inlet positioned in the exhaust line for the exhaust gas. Within the exhaust gas muffler housing a partition is arranged which comprises a damping element with multiple openings positioned in the flow path of the exhaust gas. Upon entering the exhaust gas muffler housing, the pulsating exhaust gas flow, is forced through a plurality of holes with small flow cross-section that provide a dampening or muffling effect.

In the known exhaust gas muffler the damping element is embodied as a fixedly installed planar perforated plate which divides the interior of the exhaust gas muffler housing into two muffler compartments. The inlet and the outlet of the exhaust gas muffler for the exhaust gas are correlated with different compartments so that the exhaust gas of the engine passes through the inlet opening into the first exhaust gas muffler compartment and then flows through the perforated exhaust gas muffler plate as well as an additionally provided spark protector screen into the second exhaust gas muffler compartment.

The present invention has the object to improve the aforementioned exhaust gas muffler such that the manufacturing cost of the exhaust gas muffler can be lowered while the damping or muffling effect is increased.

SUMMARY OF THE INVENTION

This object is inventively solved with the following features. A housing having an inlet and an outlet for engine exhaust gas is provided. The housing has walls defining the interior of the housing. The housing is comprised of a first housing shell having a first connecting flange and a second housing shell having a second connecting flange. The first and second connecting flanges are fastened to one another in a common flange plane. The first housing shell has a first bottom and the second housing shell has a second bottom. A partition is mounted in the housing and divides the interior of the housing into two compartments. The two compartments are connected by flow connections that allow passage of the engine exhaust gas between the two compartments. The partition has opposed ends supported respectively on the first and second bottoms. The partition has two wall portions curved outwardly in opposite directions relative to a plane of the partition and has multiple openings. The wall portions define a damping element positioned in the flow path of the engine exhaust gas from the inlet to the outlet. The multiple openings allow passage of the engine exhaust gas therethrough. The wall portions have edges that are connected to the inlet and delimit a flow cross-section of the inlet.

The invention also relates to a method for manufacturing a partition for an exhaust gas muffler wherein the two sheet metal parts are first sized to a desired size. Multiple openings are formed in a first wall portion of each one of the two sheet metal parts. The first wall portions are shaped so as to curve out of a plane of the sheet metal parts. The two sheet metal parts are joined face-to-face in a joining plane such that the first wall portions are aligned with one another but project in opposite directions away from the joining plane of the two sheet metal parts. The first wall portions define a damping element. A second wall portion of each one of the sheet metal parts is shaped so as to curve out of the plane of the sheet metal parts. The second wall portions are aligned with one another but project in opposite directions away from the joining plane of the two sheet metal parts. The second wall portions define an outlet channel.

The exhaust gas muffler housing is comprised of two housing shells which are joined at a common flange plane. The partition is a separate component which is supported at the bottom of each housing shell after insertion into the exhaust gas muffler housing. The compartments on opposite sides of the partition are connected by flow connections so that flow of the exhaust gas between the compartments can take place without impairment. Expediently, the lateral sides of the partition are positioned with play relative to the neighboring walls of the exhaust gas muffler housing so that, on the one hand, a flow connection via the gap between the partition and the neighboring housing walls is provided and a common housing volume is thus created. On the other hand, when assembling the exhaust gas muffler, the partition can be inserted into the housing shells with minimal work expenditure. When placing the second housing shell onto the first housing shell and thus closing the exhaust gas muffler housing, the partition is fixed in its position within the muffler housing by its support locations at the bottoms of the housing shells with sufficient pre-tension. The housing shells each have a peripheral flange. In the assembled position the flanges rest on one another in a common flange plane. By crimping or folding or similar mechanical means, the flange edges of the housing shells are connected to one another so that the exhaust gas muffler housing is closed and sealed.

The damping element having multiple openings for providing exhaust gas flow is embodied as an exhaust gas "shower" within the partition, wherein the term shower is used to describe an element having multiple openings through which a fluid introduced into the element can exit the element. The exhaust gas shower is delimited by perforated wall portions which relative to the plane of the partition are positioned opposite one another. The free edges of the perforated wall portion delimit the inlet cross-section. In the assembled position of the partition inside the exhaust gas muffler housing, the inlet cross-section of the exhaust gas shower overlaps the inlet of the exhaust gas muffler housing. The exhaust gas discharged from the internal combustion engine flows through the inlet in the housing wall first into the interior of the exhaust gas shower and is then forced through the openings of the perforated wall portions into the interior of the muffler housing. The exhaust gas flows out of the exhaust gas shower on either side of the partition into both compartments. The damping action on the pressure pulsation of the exhaust gas flow is improved by the simultaneous flow into the entire interior (both compartments) of the housing. Return flow of the exhaust gas on the opposite side of the partition to the outlet on the other side of the partition improves the damping action further.

In a preferred configuration of the exhaust gas muffler, the partition has an outlet channel embodied therein which opens into the outlet of the exhaust gas muffler housing. An outlet window at the surface of the partition connects the outflow channel to the interior of the exhaust gas muffler housing. The exhaust gas can flow from the exhaust gas muffler housing via the outlet window at one side of the partition into the outflow channel. The position of the outlet window on the partition can be freely selected and can be optimized with respect to the muffling behavior of the muffler. The outlet window is advantageously provided with a spark protector screen. The exhaust gas exiting from the exhaust gas shower is very hot, but because of the inventive arrangement it will not directly impact the spark protector screen so that ash formation or especially burning of the spark protector screen is prevented. The outlet window provided with the spark protector screen is spaced from the exhaust gas shower positioned adjacent thereto in the partition such that the exhaust gas, when passing through the screen, is at a temperature that is greater than a temperature range in which the spark protector screen has the tendency to experience coking. Expediently, the partition is positioned substantially perpendicularly to the flange plane of the housing shells wherein the outlet window is advantageously positioned opposite the inlet into the housing relative to the flange plane of the housing shells.

The length and especially the design and flow cross-section of the outlet channel affect the damping behavior of the exhaust gas muffler. The flow cross-section of the outlet channel is therefore advantageously adjusted to the operational behavior of the internal combustion engine. For example, at a freely selectable location within the outlet channel the exhaust gas flow can be throttled by a corresponding design of the flow cross-section so that the exhaust gas counter pressure in the exhaust gas muffler can be adjusted. The damping behavior can also be adjusted by a suitable design variation of the deflection of the exhaust gas flow within the outlet channel. With a corresponding design of the channel the course of the exhaust gas flow is determined without requiring additional components. An important effect on the damping action results from the value or change of the angle between the tangent of the thread of exhaust gas stream and of the flow direction at the outlet which is expediently positioned perpendicularly to the flange plane of the housing shells.

The partition, by having the exhaust gas shower with the outlet channel with the outlet window, comprises all of the essential elements for the muffling effect in one single component. The partition with its muffling elements can be mounted in the exhaust gas muffler in a simple manner within the housing shells. A complicated alignment of individual parts is thus no longer required with the inventive integration of the muffling or damping elements into the partition. An especially simple and inexpensive manufacture of the exhaust gas muffler is possible when the partition is comprised of two sheet metal parts joined together whereby each one of the sheet metal parts comprises a perforated wall portion of the exhaust gas shower. Each sheet metal part can be shaped into the desired form with simple cutting or shaping processes, for example, by stamping or drawing or pressing. The partition is formed by joining the two sheet metal parts. For manufacturing such a partition to be positioned in the inventive exhaust gas muffler housing, the sheet metal parts are first sized to the required areal size and, subsequently, each sheet metal part is provided with the respective cutouts at the desired locations. In the area of the wall portions for the exhaust gas shower, holes are stamped into the wall portions of the planar sheet metal parts. Subsequently or simultaneously, these wall portions are shaped into the desired form, expediently into a curved shape. In a similar manner, perforations and depressions for the outlet channel and the outlet window are provided at respective locations of the planar sheet metal. The sheet metal parts can be connected at their edges, for example, by folding or crimping.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 4.

Figure 1:
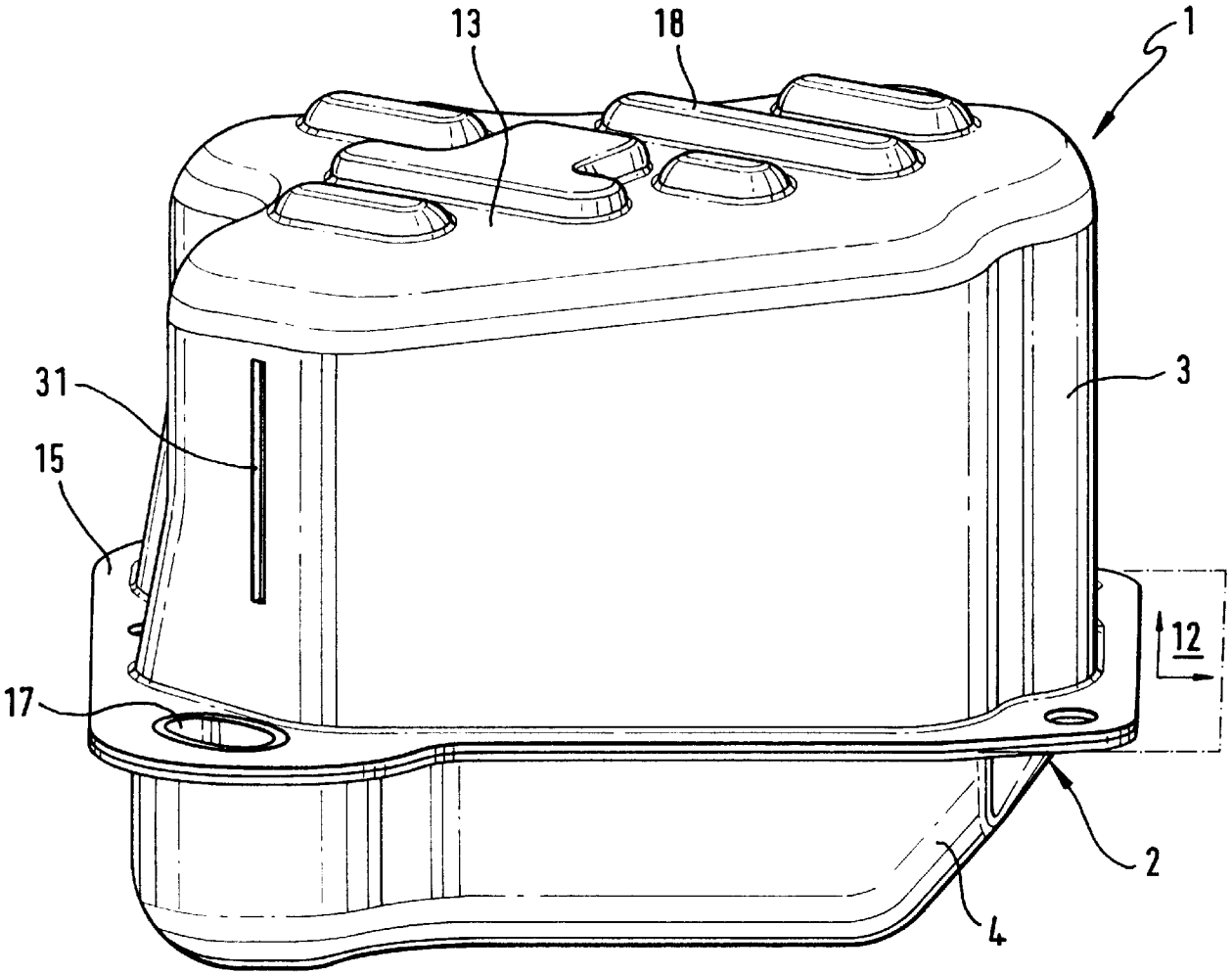
FIG. 1 shows a perspective view of an exhaust gas muffler.

The exhaust gas muffler 1 represented in FIG. 1 is to be used in the exhaust gas manifold of an internal combustion engine for reducing the operational noise of the engine. It is especially suitable for muffling internal combustion engines which are used for driving a tool of a hand-held work tool such as a chain saw etc. Such work tools and corresponding internal combustion engines are known and are therefore not explained in detail in this context.

The exhaust gas muffler 1 is expediently arranged near the exhaust gas outlet of the internal combustion engine in order to dampen the pressure pulsations in the exhaust gas stream. The engine exhaust gas is introduced via inlet 16 into the exhaust gas muffler housing 2 and exits the housing 2 through the outlet 17 free of pulsation so that a noise reduction in the exhaust gas manifold of the internal combustion engine is produced.

The exhaust gas muffler housing 2 is comprised of two housing shells, an upper housing shell 3 and a lower housing shell 4. The housing shells 3 and 4 are produced by deep-drawing of sheet metal parts and have at their open sides (opposite the bottom) a respective peripheral planar flange 15. For assembling the exhaust gas muffler housing 2, the housing shells 3, 4 are joined in a common flange plane 12 where the flanges 15 rest on one another. The housing shells 3 and 4 are expediently fastened by folding or crimping of the edges of the flanges 15 so that a fixed and tightly sealed circumferentially extending connection is produced. The two housing shells 3 and 4 are cup-shaped with a substantially planar bottom. The bottom 13 of the upper housing shell 3 has a plurality of outwardly oriented, elongate bulges 18. The bulges 18 stiffen the housing and also provide a noise reduction resulting from vibrations. On the other hand, the bulges 18 provide in the interior of the exhaust gas muffler housing two respective recesses which in the interior of the exhaust gas muffler housing 2 provide an additional volume on a side opposite the plane of the bottom 13.

The inner configuration of the exhaust gas muffler 1 will be explained in the following with FIGS. 2 through 4. For same components same reference numerals are being used.

A partition 5 is inserted into the exhaust gas muffler housing 2 and is supported respectively at the bottoms 13, 14 of the housing shells 3, 4. The partition 5 extends substantially perpendicularly to the housing shell bottoms 13, 14, respectively, to the peripheral flanges 15 of the housing shells (flange plane 12 in FIG. 1). The partition 5 divides the interior 23 of the exhaust gas muffler housing 2 into two compartments. The compartments on either side of the partition 5 communicate via flow connections allowing flow of the exhaust gas between the compartments. The unsupported lateral edges 25 of the partition 5 are positioned at least with play relative to the neighboring housing walls in order to provide a flow connection. Expediently, a gap is provided between the partition 5 and the inner surface of the housing walls 24 of the exhaust gas muffler housing 2. Furthermore, the partition 5 is provided with a plurality of cutouts 26 which allow flow of the exhaust gas between the compartments. Moreover, flow of the exhaust gas between the housing compartments is possible via the bulges 18 at the bottom 13 of the upper housing shell 3 (FIG. 3). These bulges 18 are elongate and connect the housing compartments by passing under the end of the partition 5 resting at the bottom 13 of the housing shell 3.

An inlet 16 is provided at the bottom 14 of the lower housing shell 4 (FIG. 2) for introducing the pulsating exhaust gas stream coming from the internal combustion engine into the muffler 1 to be dampened or muffled therein. The partition 5 has an exhaust gas shower 6 which with respect to the plane of the partition 5 has outwardly curved perforated wall portions 30. The free edges 29 of the perforated wall portions 30 of the exhaust gas shower 6 overlap the inlet 16 provided at the housing bottom 14. The exhaust gas flows through the inlet 16 of the exhaust gas muffler housing 2 into the interior of the exhaust gas shower 6 and then passes through the openings 6*a* in the perforated curved wall portions 30 into the two compartments 23*a*, 23*b* on either side of the partition 5 into the housing interior 23. The exhaust gas shower 6 is dome-shaped and extends upright away from the inlet 16 provided in the housing bottom 14.

An outlet channel 7 is provided in the partition 5 and opens into the outlet 17 (FIG. 1) of the exhaust gas muffler housing 2. It communicates via an outlet window 8 at the surface of the partition 5 with the interior 23 of the exhaust gas muffler housing 2. The exhaust gas flows out of the interior 23 through the outlet window 8 via a funnel-shaped mouth 9 into the outlet channel 7 and exits through the outlet 17. As can be seen especially in FIGS. 2 and 4, the exhaust gas shower 6 extends past the flange plane 12 of the flanges 15 of the housing shells 3 and 4. The outlet window 8 is arranged in a region between the tip of the exhaust gas shower 6 and the upper end of the partition 5. In the mounted position of the partition 5, the upper end rests at the housing bottom 13 of the upper housing shell 3.

The outlet window 8 has a spark protector screen 11 through which the exhaust gas will flow when entering the outlet channel 7. The spark protector screen 11 is thus not positioned directly adjacent to the entryway of the hot exhaust gas into the exhaust gas muffler housing 2 and is thus protected against burning as a result of too high temperature effects of the exhaust gas and against ash formation. The position of the outlet window 8 neighboring the exhaust gas shower 6 ensures, however, that the screen itself is still sufficiently hot in order to prevent deposition (coking).

The outlet window 8 in the shown embodiment is of an elongate design and is positioned adjacent to the housing bottom 13 of the upper housing shell 3. The outlet channel 7 extends from the funnel-shaped mouth 9 behind the outlet window 8 first in a direction toward the oppositely positioned lower housing shell 4 and is then guided in an upward curve to the outlet 17 in the housing 2 (see FIG. 2). The outlet 17 is positioned, as can be seen in FIG. 1, in the flange plane 12 of the flanges 15. It is also possible to have other configurations of the outlet channel 7. With a suitable selection of the length of the outlet channel 7 and especially of the parameters of the flow deflection and the flow cross-section of the outlet channel 7, the damping effect of the exhaust gas muffler 1 can be effected. The flow cross-section of the outlet channel 7 is accordingly adjusted to the operational behavior of the internal combustion engine in which the muffler is used. The flow cross-section of the outlet channel 7 can be narrowed at any freely selectable position. The resulting throttle location of the exhaust gas stream at the narrow passage allows adjustment of the exhaust gas pressure of the exhaust gas muffler 1.

The invention suggests to combine the essential damping elements of the exhaust gas muffler in one single component in the form of the partition 5 provided with the exhaust gas shower 6 and the exhaust gas outlet channel 7. The partition 5 is thus inserted as a complete, single component into the housing shells 3, 4 when assembling the exhaust gas muffler 1. Advantageously, the partition is inserted into the upper housing shell 3 (FIG. 3) and connected to the bottom 13 of the upper housing shell 3. As can be seen in FIG. 3, the partition 5 has a leg 22 which extends perpendicularly to the plane of the partition. The partition 5 is placed with this leg 22 onto the bottom 13 of the housing shell 3.

Figure 4:
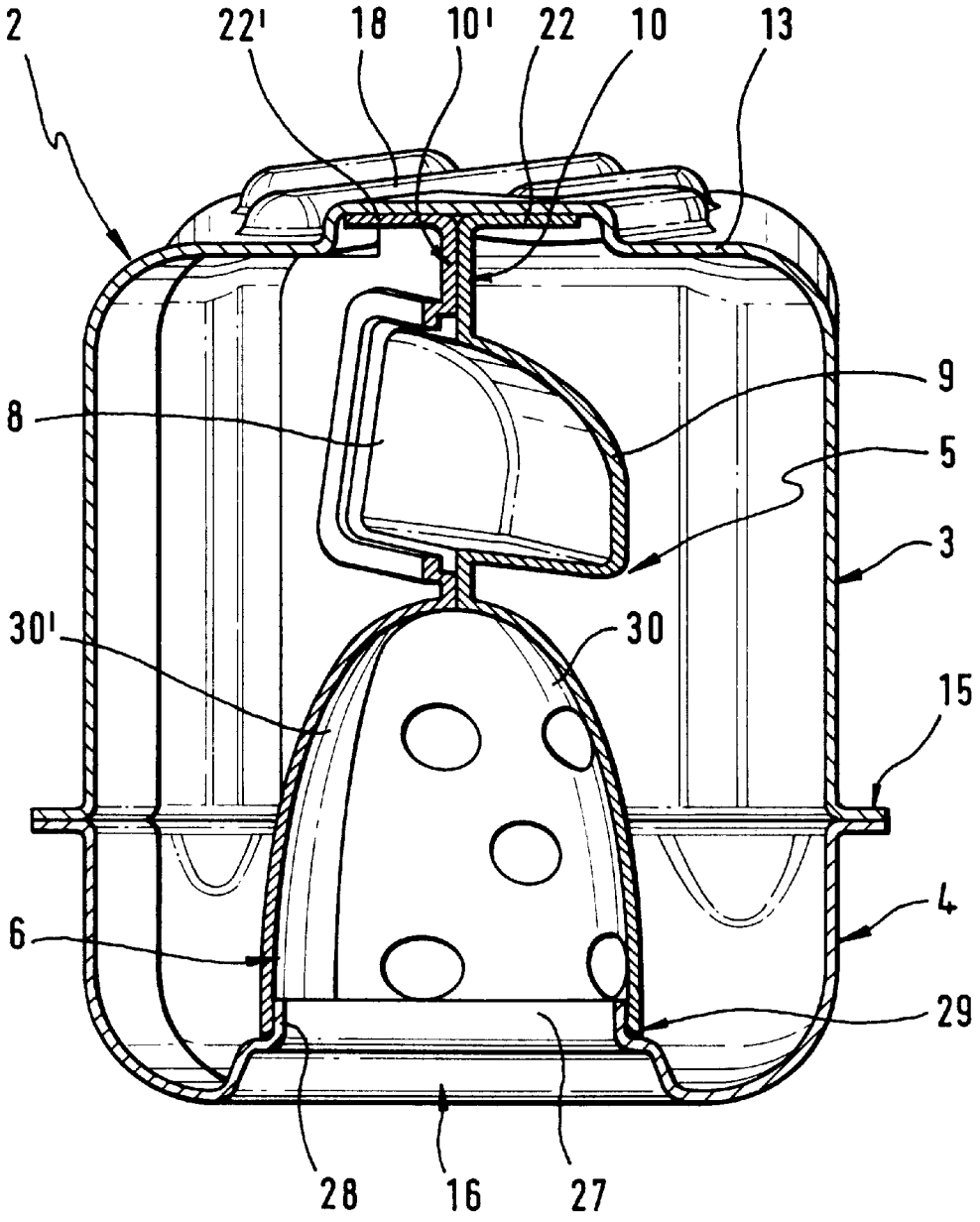
FIG. 4 shows a sectioned view of the exhaust gas muffler housing along a section line through the partition.

FIG. 4 shows clearly that the leg 22 of the partition 5 projects into one of the bulges 18 at the bottom 13 of the upper housing shell 3 and thus secures the partition 5 in its position. In this representation, the embodiment of the exhaust gas shower 6 with its curved, perforated wall portions 30 can be seen in detail. The flow cross-section of the dome-shaped exhaust gas shower 6 widens continuously and substantially elliptically toward its open end, i.e., the inlet cross-section 27.

The sheet metal wall (bottom) of the lower housing shell 4 is drawn in the area of the inlet 16 of the exhaust gas muffler housing 2 to a collar 28 into the interior 23 of the housing 2. In the shown mounted position of the partition 5, the collar 28 of the lower housing shell 4 and the free edges 29 of the exhaust gas shower 6 overlap one another and thus form a peripheral seal for the housing 2. When assembling the exhaust gas muffler housing 2, the partition 5 is first inserted into the upper housing shell 3 and is secured by the leg 22 in the upright position within the housing shell 3. For completing the assembly of the muffler, the lower housing shell 4 is then placed with its peripheral flange 15 onto the matching flange of the upper housing shell 3 whereby the collar 28 in the shell bottom 14 engages the exhaust gas shower 6. The collar 28 can be provided with a shoulder for the peripheral edge 29 of the exhaust gas shower 6. This shoulder can provide pre-tension for the partition 5 when assembling the housing shells 3 and 4.

Figure 2:
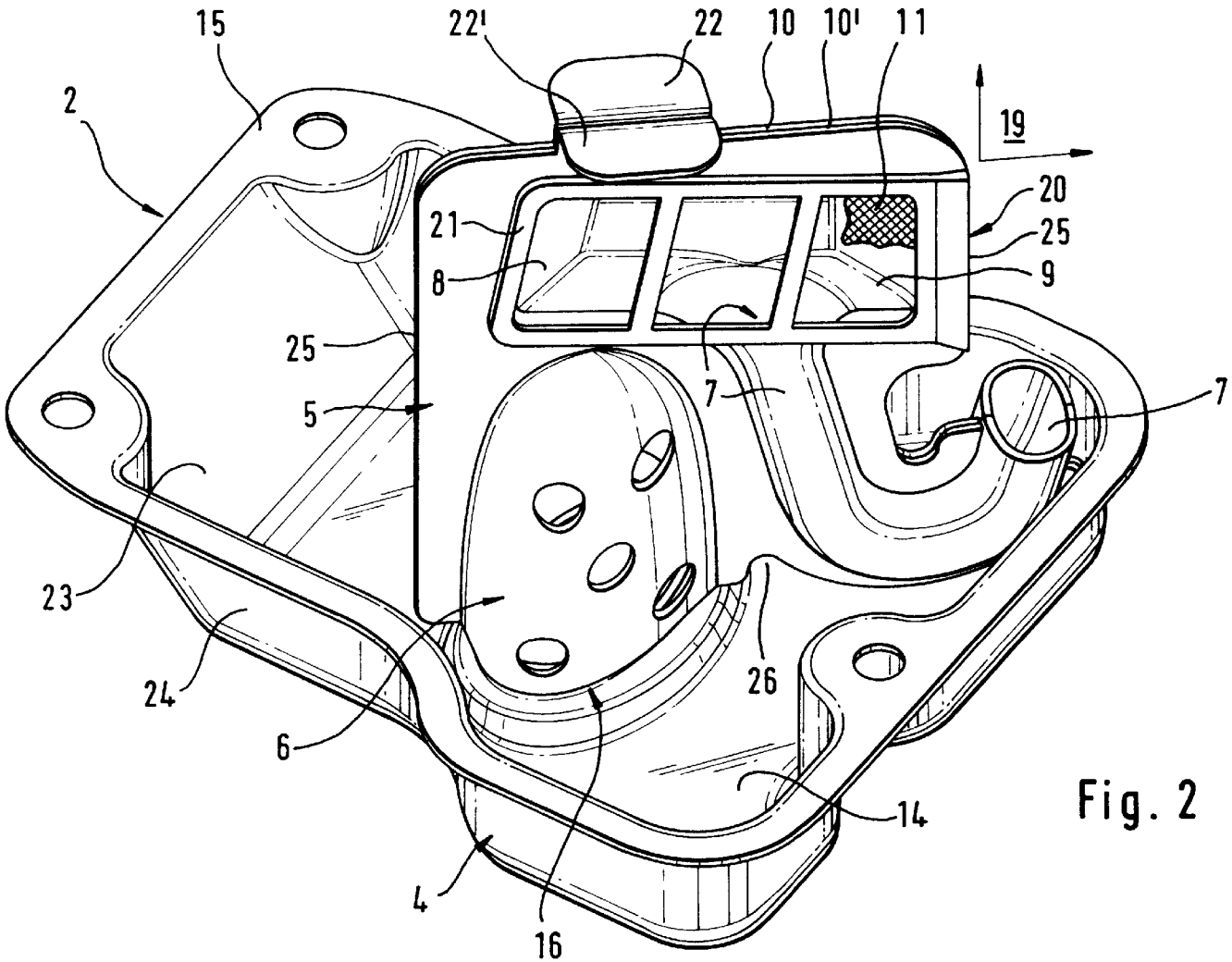
FIG. 2 shows a perspective view of the lower housing shell of the exhaust gas muffler with inserted partitions.
Figure 3:
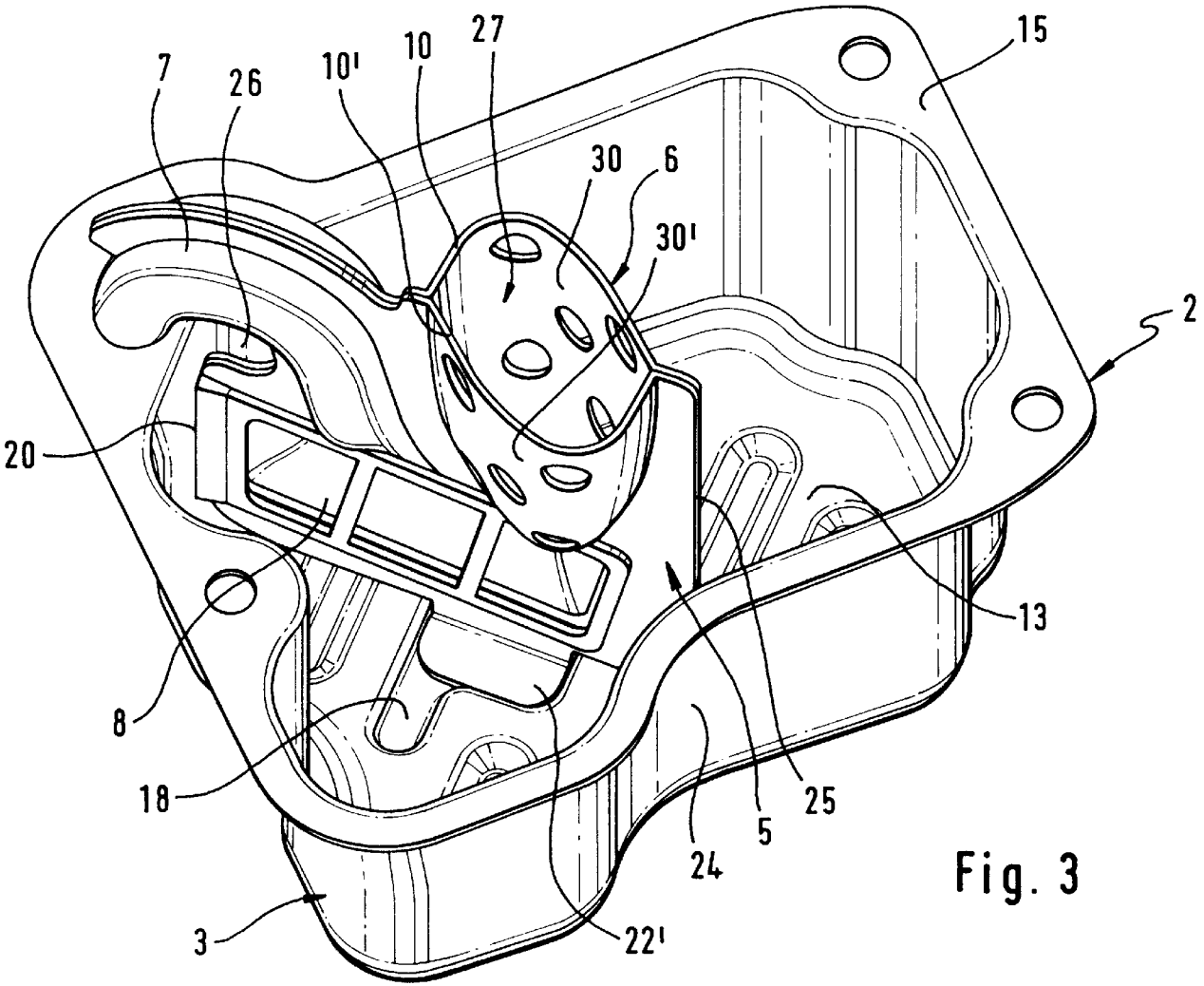
FIG. 3 shows a perspective view of upper housing shell of the exhaust gas muffler housing with inserted partition.

As can be seen in the drawing FIGS. 2 through 4, the partition 5 is comprised of two sheet metal parts 10 and 10' which are connected to one another face-to-face wherein each one of the sheet metal parts 10, 10' has a perforated wall portion 30 for forming the exhaust gas shower 6. Also, each sheet metal part 10 and 10' provides a portion of the outlet channel 7. The outlet channel 7 is expediently symmetric whereby the planar joining surface between the sheet metal parts 10 and 10' is the plane of symmetry of the outlet channel 7. When manufacturing the partition 5, the curved wall portions 30 of the exhaust gas shower 6 as well as of the outlet channel 7 are formed by respective suitable shaping methods, for example, by drawing. The shown design of the exhaust gas shower 6 and of the outlet channel 7 results from the joining of the two sheet metal parts 10 and 10' which are mirror symmetrical to one another with respect to the embodiment of the exhaust gas shower 6 and the outlet channel 7. The sheet metal part 10' is provided with penetrations for the outlet window 8, for example, by stamping. As is shown in the drawings, the outlet window 8 can be divided by multiple stays so as to form multiple flow areas. The sheet metal part 10 is provided with a funnel-shaped mouth 9 of the outlet channel 7 which, after joining of the sheet metal parts 10 and 10' to form the partition 5, is positioned behind the outlet window 8.

The outlet window 8, as can be seen in FIG. 2 and 3, has a frame 21 which projects from the plane of the sheet metal parts. The frame 21 can be provided in the sheet metal part during manufacture of the partition 5 by methods such as shaping or pressing or drawing or similar deforming methods. The outlet window 8 with its frame 21 extends to the lateral side or edge 25 of the partition 5. Between the frame 21 and the second sheet metal part which has the funnel-shaped mouth 9, a gap is formed into which the spark protector screen 11 is inserted. The gap is open toward the lateral edge 25 of the partition 5 so that an insertion slot 20 for the spark protector screen 11 is formed. The lateral edge 25 with the opening of the insertion slot 20 is positioned in the mounted position of the partition 5 in the exhaust gas muffler housing 2 in a position adjacent to the housing wall. In the housing wall, as shown in FIG. 1, a slot 31 is arranged which is aligned with the insertion slot 20 so that the spark protector screen 11 can be exchanged at regular intervals without having to disassemble the exhaust gas muffler housing.

The sheet metal parts 10 and 10' can be connected to one another expediently by folding or crimping or similar means at their edges 25. Each one of the sheet metal parts 10, 10' forms a portion of the leg 22, 22' wherein at each one of the sheet metal parts 10, 10' a tongue is formed that projects past the folded edge. When shaping of the sheet metal parts before joining, the tongues are bent outwardly about a bending line.

The simple manufacture of individual sheet metal parts which are subsequently shaped according to the desired form and which are then joined face-to-face results in a partition that can be manufactured inexpensively. Before joining of the two sheet metal parts in a common joining plane, the shaped and machined sheet metal strips are first sized to the desired size and the edges 25 of the partition 5 to be manufactured are formed together with the cutouts 26 in the partition 5. The cutouts 26 in the mounted position of the partition 5 provide a flow connection between the compartments 23*a*, 23*b* on either side of the partition 5. In a subsequent or in the same machining step, the sheet metal parts 10, 10' can be provided with openings or holes 6*a* for the wall portions 30 that are to form the exhaust gas shower 6. The thus prepared sheet metal 10' is provided with penetrations for the outlet window 8. The various penetrations and openings in the respective sheet metal parts 10, 10' are produced by suitable processes such as cutting or stamping. Subsequently, the respective sheet metal part 10, 10' is shaped before joining to the desired final shape: the required depressions for the outlet channel 7, the frame 21 of the outlet window 8 for forming the insertion slot 20 for the spark protector screen 11 and especially the wall portions 30 of in a curved design for forming the exhaust gas shower 6 are produced. The shaping of the sheet metal parts 10, 10' into the desired shape can be performed expediently by deep-drawing.

The specification incorporates by reference the disclosure of German priority document 198 49 118.2 of Oct. 24, 1998.

The present invention is, of course, in no way restricted to the specific disclosure of the specification and drawings, but also encompasses any modifications within the scope of the appended claims.

What is claimed is:

1. An exhaust gas muffler for an internal combustion engine, said exhaust gas muffler comprising:

a housing (2) having an inlet (16) and an outlet (17) for engine exhaust gas;

said housing (2) having walls defining an interior (23) of said housing (2). said housing (2) comprised of a first housing shell (3) having a first connecting flange (15) and a second housing shell (4) having a second connecting flange (15), wherein said first and second connecting flanges (15) are fastened to one another in a common flange plane (12);

said first housing shell (3) having a first bottom (13) and said second housing shell (4) having a second bottom (14);

a partition (5) mounted in said housing (2) and dividing an interior of said housing (2) into two compartments;

said two compartments connected by flow connections allowing passage of the engine exhaust gas between said two compartments;

said partition (5) having opposed ends supported respectively on said first and second bottoms (13, 14);

said partition (5) having two wall portions (30) curved outwardly in opposite directions relative to a plane of said partition (5) and having multiple openings (6*a*);

said wall portions (30) defining a damping element (6) positioned in a flow path of the engine exhaust gas from said inlet (16) to said outlet (17);

said multiple openings (6*a*) allowing passage of the engine exhaust gas therethrough;

said wall portions (30) having edges (29) connected to said inlet (16) and delimiting a flow cross-section of said inlet (16).

2. An exhaust gas muffler according to claim 1, wherein said partition (5) has lateral edges (25) extending between said opposed ends and wherein said lateral edges (25) are positioned at a spacing to neighboring ones of said walls of said housing (2), wherein said spacing defines one of said flow connections.

3. An exhaust gas muffler according to claim 1, wherein said partition (5) comprises an outlet channel (7) connected to said outlet (17) and having an outlet window (8) opening into said interior (23) to allow flow of the exhaust from said interior (23) through said outlet window (8) and said outlet channel (7) to said outlet (17).

4. An exhaust gas muffler according to claim 3, wherein a flow cross-section of said outlet channel (7) is matched to the operating behavior of the internal combustion engine.

5. An exhaust gas muffler according to claim 3, further comprising a spark protector screen (11) covering said outlet window (8).

6. An exhaust gas muffler according to claim 1, wherein said partition (5) is comprised of a first sheet metal part (10) and a second sheet metal part (10'), wherein said first sheet metal part (10) comprises one of said wall portions (30) and wherein said second sheet metal part (10') comprises the other one of said wall portions (30).

7. An exhaust gas muffler according to claim 6, wherein said two wall portions (30) are curved.

8. An exhaust gas muffler according to claim 6, wherein said outlet window (8) is provided in said first sheet metal part (10'), wherein said second sheet metal part (10) has a funnel-shaped portion (9) defining a funnel mouth of said outlet channel (7), wherein said funnel mouth (9) is aligned with said outlet window (8).

9. An exhaust gas muffler according to claim 8, further comprising a spark protector screen (11) for covering said outlet window (8), wherein said outlet window (8) and said funnel mouth (9) define an insertion gap (20) and wherein said spark protector screen (11) is mounted in said gap (20).

10. An exhaust gas muffler according to claim 9, wherein said outlet window (8) is positioned adjacent to a first one of said lateral sides (25) and wherein said spark protector screen (11) extends laterally past said outlet window (8) to said first lateral side (25) of said partition (5).

11. An exhaust gas muffler according to claim 1, wherein at least one of said walls of said housing (2) has outwardly projecting elongate bulges (18) defining second ones of said flow connections.

12. An exhaust gas muffler according to claim 1, wherein said outlet window (8) and said inlet (16) are positioned on opposite sides of said flange plane (12).

13. An exhaust gas muffler according to claim 1, wherein said partition (5) is fastened to said first bottom (13) and wherein said inlet (16) is provided in said second bottom (14).

14. An exhaust gas muffler according to claim 13, wherein said inlet (16) is a monolithic part of said second bottom (14).

15. An exhaust gas muffler according to claim 14, wherein said inlet (16) has a collar (28) drawn into said interior (23) and wherein said collar (28) and said edges (29) of said damping element (6) are inserted into one another.

16. A method for manufacturing a partition for an exhaust gas muffler, said method comprising the steps of:

sizing two sheet metal parts (10, 10') to a desired size;

forming multiple openings **(6*a*) in a first wall portion of each one of said two sheet metal parts (10, 10')**;

shaping said first wall portions (30) so as to curve out of a plane of said sheet metal parts (10, 10');

joining said two sheet metal parts (10, 10') face to face in a joining plane such that said first wall portions (30) are aligned with one another but project in opposite directions away from said joining plane of said two sheet metal parts (10, 10'), wherein said first wall portions (30) define a damping element.

17. A method according to claim 16, further comprising the step of shaping a second wall portion of each one of said sheet metal parts (10, 10') so as to curve out of said plane of said sheet metal parts (10, 10') before said step of joining, wherein said second wall portions are aligned with one another in said step of joining but project in opposite directions away from said joining plane of said two sheet metal parts (10, 10'), wherein said second wall portions define an outlet channel (7, 8, 9).

18. A method according to claim 16, wherein said step of sizing and said step of forming openings are performed simultaneously.

* * * * *